US009119757B2

(12) United States Patent
Triolo et al.

(10) Patent No.: US 9,119,757 B2
(45) Date of Patent: Sep. 1, 2015

(54) SELF LEVELING WALKER

(71) Applicants: The United States of America, as represented by the Department of Veterans Affairs, Washington, DC (US); Case Western Reserve University, Cleveland, OH (US)

(72) Inventors: Ronald J. Triolo, Cleveland Heights, OH (US); Thomas C. Bulea, Cleveland, OH (US)

(73) Assignees: The United States of America as Represented by the Dept. of Veterans Affairs, Washington, DC (US); Case Western Reserve University, Cleveland, OH (US)

( * ) Notice: Subject to any disclaimer, the term of this patent is extended or adjusted under 35 U.S.C. 154(b) by 0 days.

(21) Appl. No.: 14/059,667

(22) Filed: Oct. 22, 2013

(65) Prior Publication Data

US 2014/0109944 A1 Apr. 24, 2014

Related U.S. Application Data

(60) Provisional application No. 61/795,744, filed on Oct. 23, 2012.

(51) Int. Cl.
*A61H 3/00* (2006.01)

(52) U.S. Cl.
CPC ..... *A61H 3/00* (2013.01); *A61H 2003/001* (2013.01); *A61H 2201/0192* (2013.01); *A61H 2201/1246* (2013.01); *A61H 2201/5051* (2013.01); *A61H 2201/5058* (2013.01);
(Continued)

(58) Field of Classification Search
CPC ..... A61H 2003/001; A61H 3/00; A61H 2201/5051; A61H 2201/5053; A61H 2201/5056
USPC ..... 135/67, 70, 75; 280/87.05
See application file for complete search history.

(56) References Cited

U.S. PATENT DOCUMENTS 2,908,472 A * 10/1959 McDonald ..... 248/346.05
3,157,188 A * 11/1964 Farnham ..... 135/69
(Continued)

OTHER PUBLICATIONS

Stabilus Walkers and Lifting Aids (Online Catalog): Commercial products, as specifically published at: http://www.stabilus.com/applications/rehabilitation-applications/walkers-lifting-aids.html.
(Continued)

*Primary Examiner* — Noah Chandler Hawk
(74) *Attorney, Agent, or Firm* — Robert S. M. Gorman; Gorman Law Offices

(57) ABSTRACT

This invention relates to a self leveling walker to assist persons who have insufficient strength or movement in their legs when standing and walking on uneven surfaces, and for traversing ramps and stairs. The inventive self leveling walker includes a frame assembly with a leveling assembly for adapting the relative length of the four legs of the walker to accommodate a substantially constant level of the walker so that the user may maintain an erect standing posture at all times, without the need to lean forward or back to accommodate uneven surfaces. The invention employs a fluid or gas based circuit between the front and back walker legs on each respective side, so as to shorten or lengthen each front and back leg with respect to each other, thereby maintaining the overall level of the walker on the subject surface being traversed.

29 Claims, 13 Drawing Sheets

Hydraulic fluid flow in self-leveling walker

(52) U.S. Cl.
CPC . *A61H2201/5069* (2013.01); *A61H 2201/5071* (2013.01); *A61H 2201/5084* (2013.01)

(56) References Cited

U.S. PATENT DOCUMENTS

| | | | | | |
|---|---|---|---|---|---|
| 3,176,700 | A | | 4/1965 | Drury, Jr. | |
| 3,387,617 | A | * | 6/1968 | Reiber | 135/67 |
| 3,416,546 | A | * | 12/1968 | Carpenter | 135/68 |
| 3,455,313 | A | * | 7/1969 | King | 135/67 |
| 3,800,815 | A | | 4/1974 | Birk | |
| 4,777,973 | A | | 10/1988 | Nakajima | |
| 5,349,977 | A | | 9/1994 | Wood | |
| 5,365,621 | A | | 11/1994 | Blain | |
| 5,636,651 | A | | 6/1997 | Einbinder | |
| 5,649,558 | A | | 7/1997 | Richard | |
| 6,145,524 | A | | 11/2000 | Li et al. | |
| 6,453,921 | B1 | | 9/2002 | Rost | |
| 7,278,436 | B2 | | 10/2007 | Gale | |
| 7,669,863 | B2 | | 3/2010 | Steiner et al. | |
| 7,918,237 | B1 | * | 4/2011 | Kuo et al. | 135/65 |
| 8,667,976 | B2 | * | 3/2014 | Huang | 135/67 |
| 2012/0298160 | A1 | * | 11/2012 | Hamilton | 135/66 |

OTHER PUBLICATIONS

Great Lakes Innovation: Commercial products, as published at: http://www.tinventor.com/Product-Stair%20climbing%20walker.htm.

* cited by examiner

Hydraulic fluid flow in self-leveling walker

Block diagram of self-leveling hydraulic walker circuitry.

Illustrative algorithm for automatic lock/unlock control of walker based on accelerometer outputs.

SELF LEVELING WALKER

This application claims priority from U.S. provisional application No. 61/795,744, filed on Oct. 23, 2012, the contents of which are hereby incorporated by reference in the entirety.

Government License Rights

This invention was made with government support under grant number EB001889 awarded by the National Institutes for Health. The government has certain rights in the present invention.

FIELD OF THE INVENTION

The present invention is related to the field of ambulatory assist devices, that is, walkers. Specifically, aspects of the invention provide a self leveling walker having assemblies on each side of the walker for continuous and reciprocal extension and retraction of the front set of legs and the back set of legs in order to assist the user in negotiating slopes and steps while maintaining a relatively erect standing position, without the need to lean forwards or backwards. The proposed invention therefore relates to a novel approach to improving walkers in such a way that walking functions for users are greatly improved when traversing uneven or sloped surfaces and stairs, and transitioning easily between level and inclined surfaces and stairs.

BACKGROUND OF THE INVENTION

Known approaches for walkers often incorporate rigid legs and the like, something which is not desirable because they cannot offer a square, level frame for constant upright standing posture throughout the entire range of user motion, a key feature that is important for the stable ambulation of a user who is prone to fall when leaning backwards or forward when traversing inclined, or conversely, declined slopes or stairs.

BRIEF DESCRIPTION OF THE DRAWINGS

The subject matter which is regarded as one embodiment of the invention is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

SUMMARY OF THE INVENTION

Figure 1:
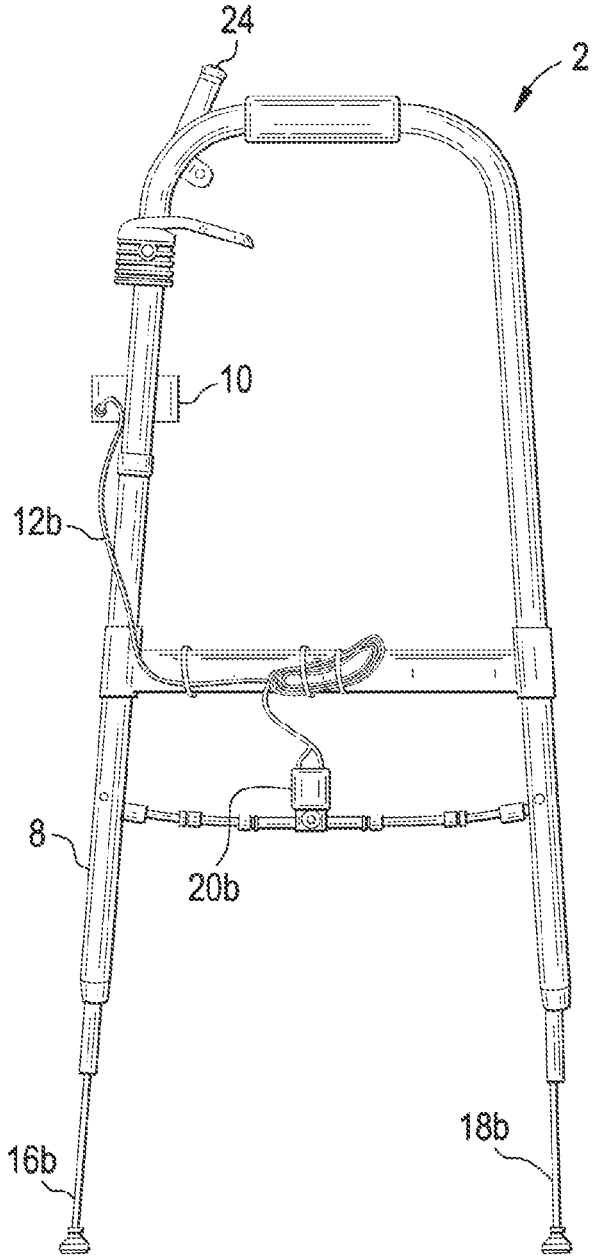
FIG. 1 is a side view of the self leveling walker of the present invention.

The walker in accordance with this invention relates to a novel approach to improving the use of walkers, by offering a walker that can continuously and automatically level its four legs, in some cases independently from each other, with a simple hydraulic or pneumatic circuit or other means. The initial height of the walker can first be customized for the individual user by manipulating telescopic extensions as in conventional devices, then the relative lengths of each leg can be adjusted for uneven surfaces and stairs through the use of tubes within the legs of the walker which are filled with hydraulic fluid (or gas, in cases of pneumatic instantiations) that along with the lower, adjustable members define a closed cylinder. Alternatively, the lower portion of each leg can contain an individual leveling piston or cylinder. With the above, a valve is located in the hydraulic circuit between the front and back legs on each side, and is normally closed (whereby all four legs are of fixed and unchanging height), until activated. When activated (either by manual control by pushing and holding a control button, or alternatively, by automatic control through the use of sensors), both valves are opened and fluid can flow back and forth between the respective sets of front and back legs. As the user leans forward, body weight creates pressure on the front legs causing fluid to flow to the rear legs, shortening the front and extending the back of the walker. When the control is released, the valves close to stop fluid flow and lock the new height of the front and back legs in place. The inventive walker then maintains its new configuration as the user negotiates the slanted or uneven surface, so that the user can more easily negotiate up or down ramps or ascending or descending steps in a stable upright vertical posture, thereby eliminating the problems inherent in a conventional walker which severely obstructs usage on sloped surfaces, especially during the climbing of stairs because of the fixed leg height which makes the walker unstable on steps and the like. In one embodiment, the hydraulic circuit between the front and back legs may be connected with additional valves between the left side and right side of the self leveling walker, in order to adjust for surfaces that are laterally (e.g. side-to-side) uneven in view of the path of travel by a user. In other embodiments, hydraulics and pneumatics may be supplanted by alternative variants employing chain- or cable-driven linkages between front and back legs, with a clutches that would engage or disengage with the press of a control button, or by controlling the same with electric motors. When implemented as described herein, the inventive self leveling walker essentially employs a self leveling mechanism that is able to consistently ensure that the walker and the user thereof, maintain a vertical posture that is consistently perpendicular to a gravitational vector (e.g., perpendicular along a vertical axis to a horizontal level or axis). Also, in at least one embodiment, the inventive self leveling walker provides for automatic self-leveling features described herein, the provision of which affords smooth, continuous adjustability when compared with say, discrete, inflexible gradients of user-initiated adjustment based mechanics.

In affording the above, the present invention provides for the following beneficial advances relating to: (1) Provision of a unique design that allows the walker, and therefore the user thereof, to remain in a substantially erect or upright standing position, essentially eliminating any leaning forwards or backwards from the vertical position during the course of traversal of uneven or sloping surface areas (e.g., the user need not lean backwards or forward with respect to the slope of the surface of traversal); (2) Provision of features which, unlike conventional static (e.g., non-adjustable) walkers, are hydraulic, pneumatic, spring loaded and/or air piston (cylinder) based, all of which is self sensing in terms of relative leg adjustment heights between the front and rear legs; (3) Provision of dual control actuation for accidental engagement of the leveling mechanism; (4) Provision of optional single-sided (keyed or squared) leveling cylinders with spring assisted returns which minimize friction, reduce the weight of the configuration, and which also facilitate returning the legs of the walker to an initial default (equally extended) configuration. The above therefore prevents falls that can occur from leaning to accommodate slopes or stairs, and increases independence and quality of life overall. To this end, the present invention overcomes the aforementioned and other disadvantages inherent in the prior art.

DETAILED DESCRIPTION OF THE INVENTION

Figure 2:
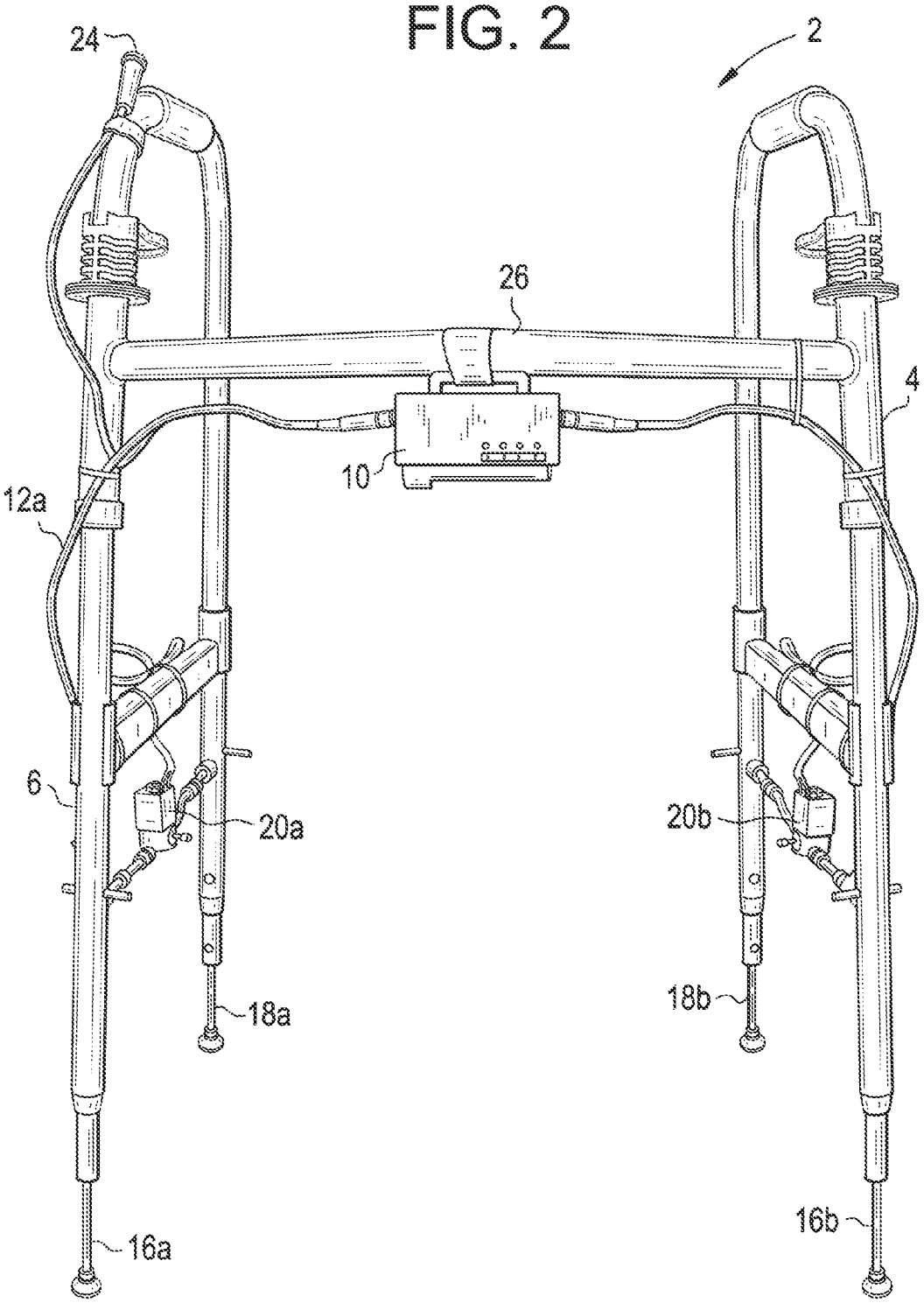
FIG. 2 is a frontal view of the self leveling walker of the present invention.
Figure 3:
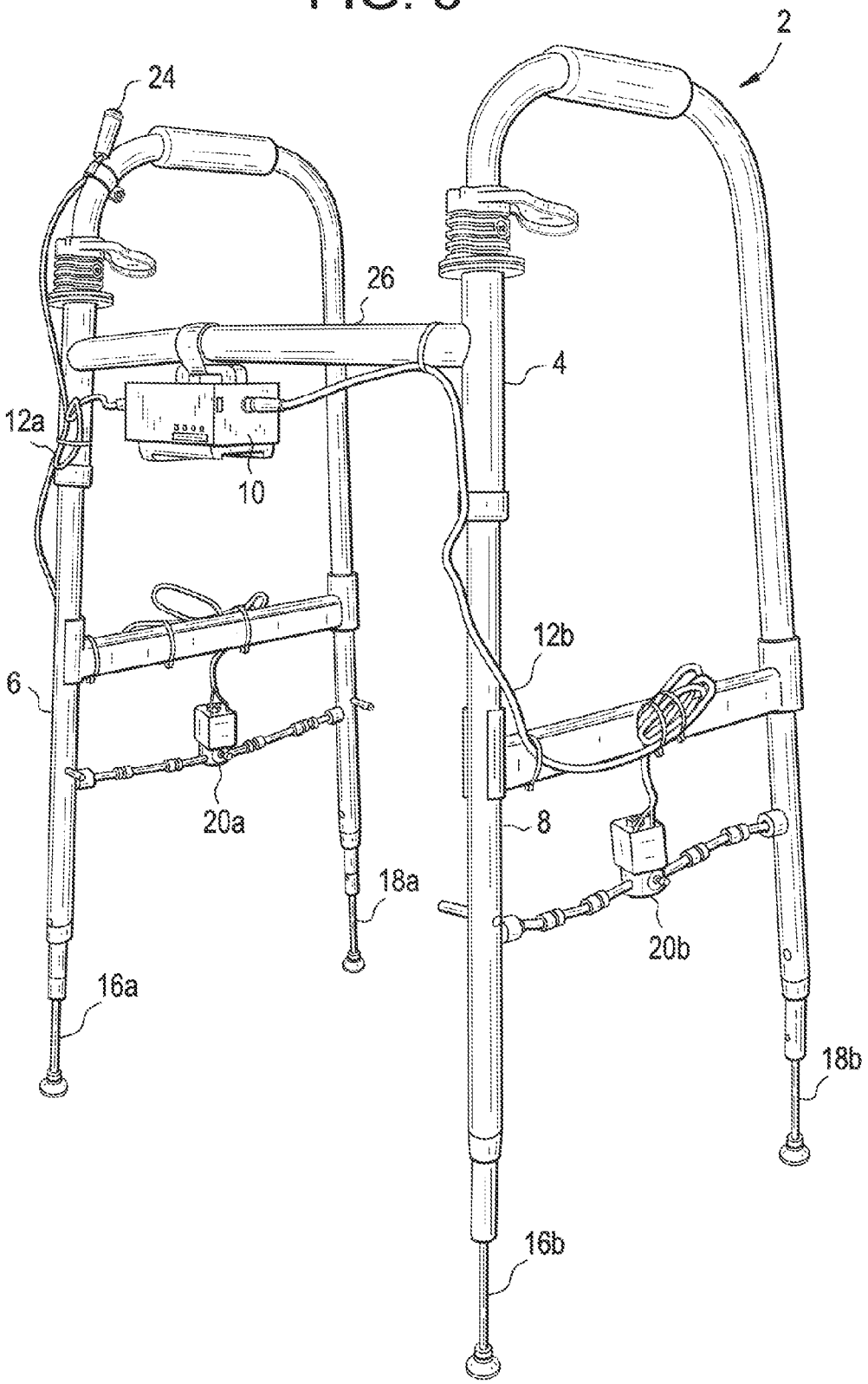
FIG. 3 is a frontal, side perspective view of the self leveling walker of the present invention.

The present invention therefore provides an ambulatory "self leveling walker," having a leveling assembly that can raise (extend) and/or lower (retract) the front legs cooperatively with the back legs, and vice-versa when on flat surfaces, or in opposition to each other in order to assist the user in negotiating slopes, uneven surfaces and stairs. Referring now to the embodiment shown in FIG. 1, with cross-reference to alternative perspective views FIGS. 2 and 3, there is illustrated, at its broadest level, the inventive self-leveling walker 2 comprising: a frame assembly 4 having: a left frame support 6 and a right frame support 8 wherein left frame support 6 and right frame support 8 each have an upper portion and a lower portion, and a front portion and a rear portion; a bracing support 26 for connecting left frame support 6 and right frame support 8; a pair of adjustable front legs 16*a*, 16*b* wherein the pair of adjustable front legs includes one adjustable front leg 16*a* extending from the front, lower portion of the left frame support, and one adjustable front leg 16*b* extending from the front, lower portion of the right frame support; a pair of adjustable rear legs 18*a*, 18*b*, wherein the pair of adjustable rear legs includes one adjustable rear leg 18*a* extending from the rear, lower portion of the left frame support, and one adjustable rear leg 18*b* extending from the rear, lower portion of the right frame support; a leveling assembly 10 mounted to (or within) frame assembly 4, wherein leveling assembly 10 comprises an optional electronic circuitry unit and associated battery within a housing, and at least: an activation mechanism (comprised of components such as side valves, activation lines, control buttons and/or sensors, described hereafter and also mounted to or within the frame assembly) for controlling and effectuating extension and retraction of the pair of adjustable front legs 16*a*, 16*b*, in tandem and for controlling and effectuating extension and retraction of the pair of adjustable rear legs 18*a*, 18*b*, in tandem, said activation mechanism controlling and effectuating the extension and retraction of pair of adjustable front legs 16*a*, 16*b*, in tandem and controlling and effectuating said extension and retraction of said pair of adjustable rear legs 18*a*, 18*b*, in tandem together in a synchronized or asynchronous (opposite) fashion, in order to effectuate a surface-dependent alignment of said pair of adjustable front legs 16*a*, 16*b*, and said pair of adjustable rear legs 18*a*, 18*b*. Leveling assembly 10 is mounted to, or alternatively, within the tubes or braces that make up frame assembly 4, such as bracing support 26. To minimize weight and enhance modularity, in one embodiment, frame assembly 4 might be constructed from said, 1-inch outer diameter aluminum piping with say, an illustrative 0.113 inch wall thickness or the like, and may be connected by exemplary structural fittings (not specifically depicted) such as elbows or tees, and adjacent pipe lengths might be placed in such fittings and secured using set screws tightened on flattened sections of pipe, although the present invention is not meant to be limited by such an illustrative example.

Figure 4A:
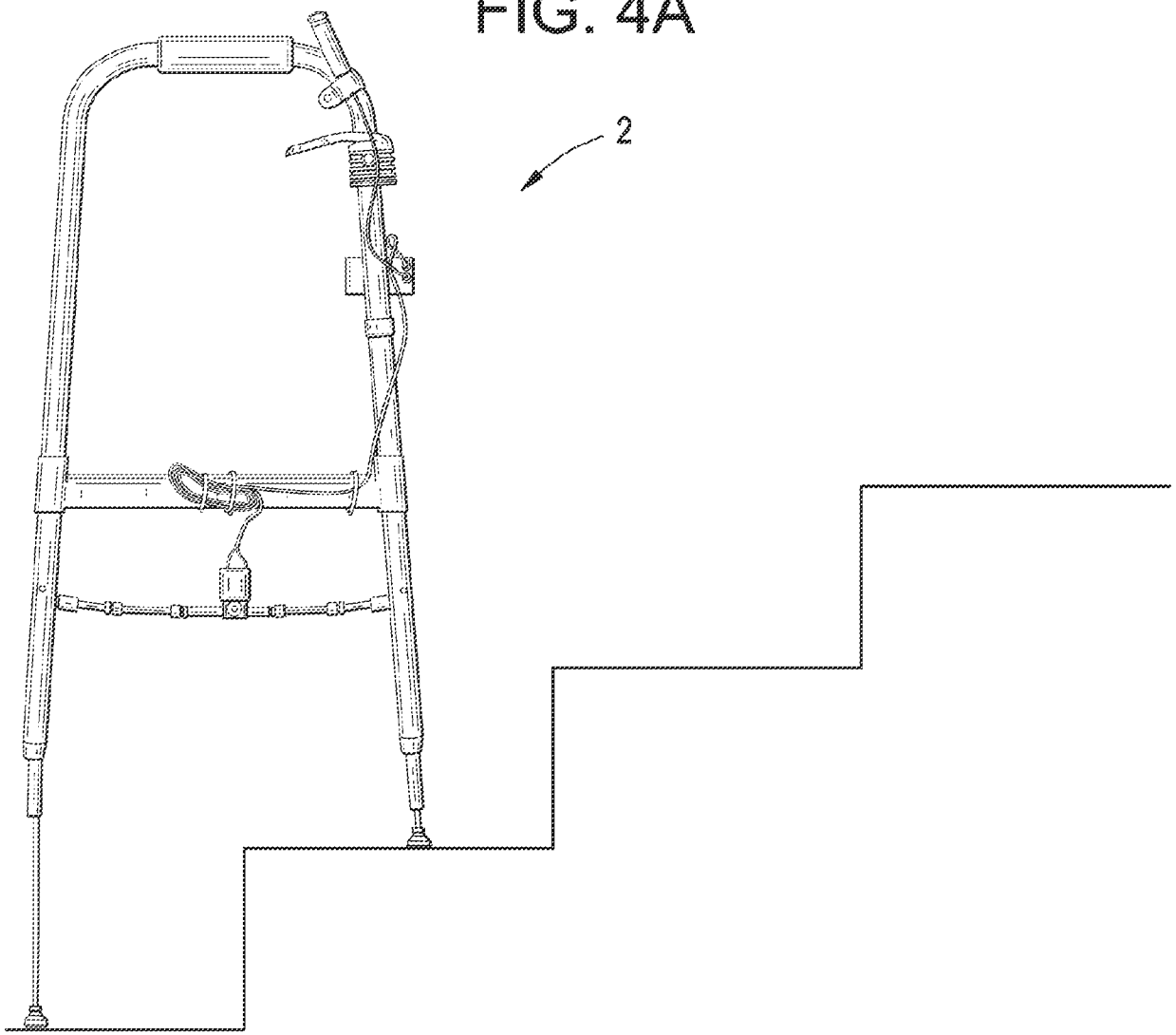
FIG. 4A is a side view of the self leveling walker of the present invention as illustratively employed during stair ascent.
Figure 4B:
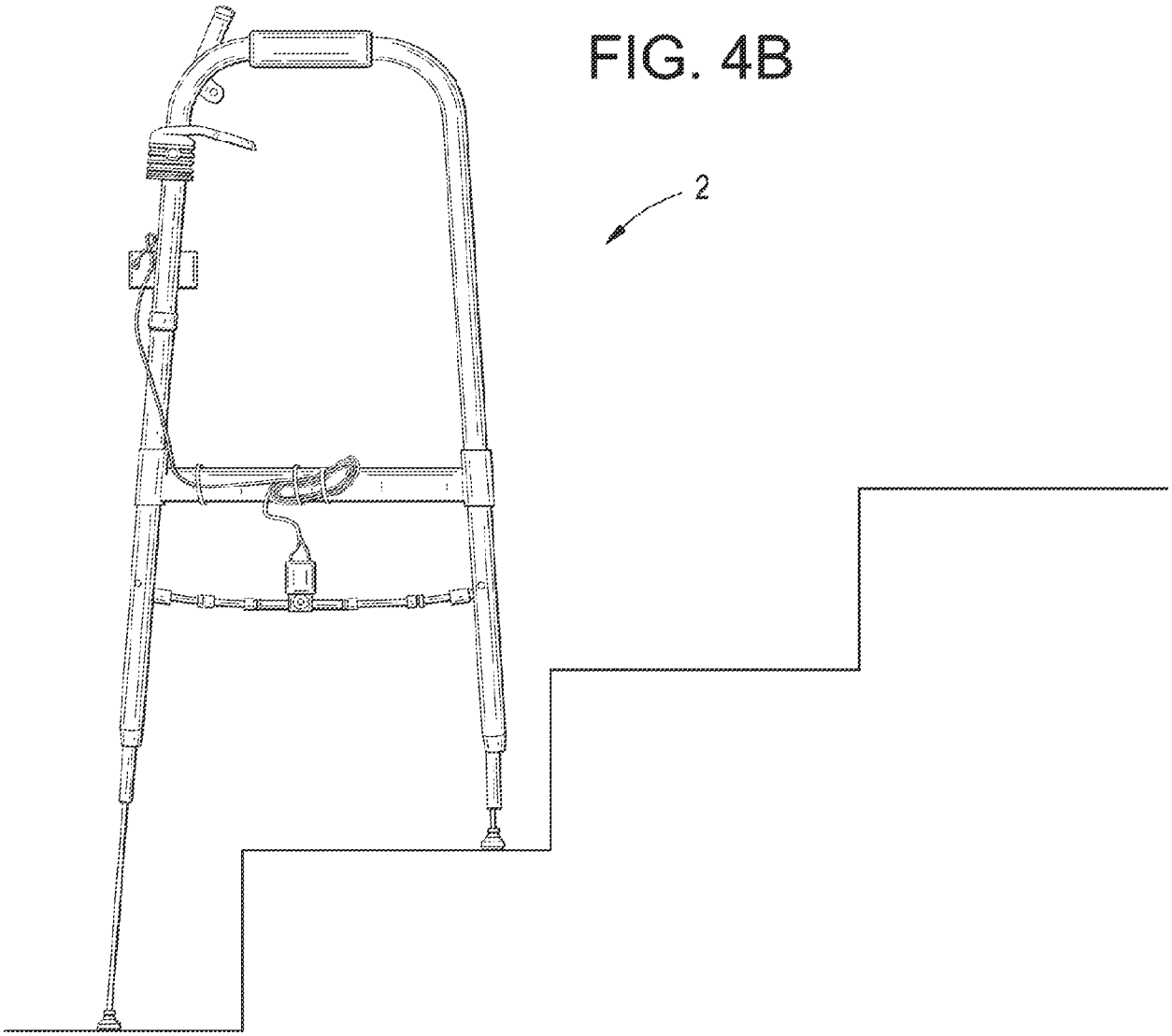
FIG. 4B is a side view of the self leveling walker of the present invention as illustratively employed during stair descent.
Figure 5B:
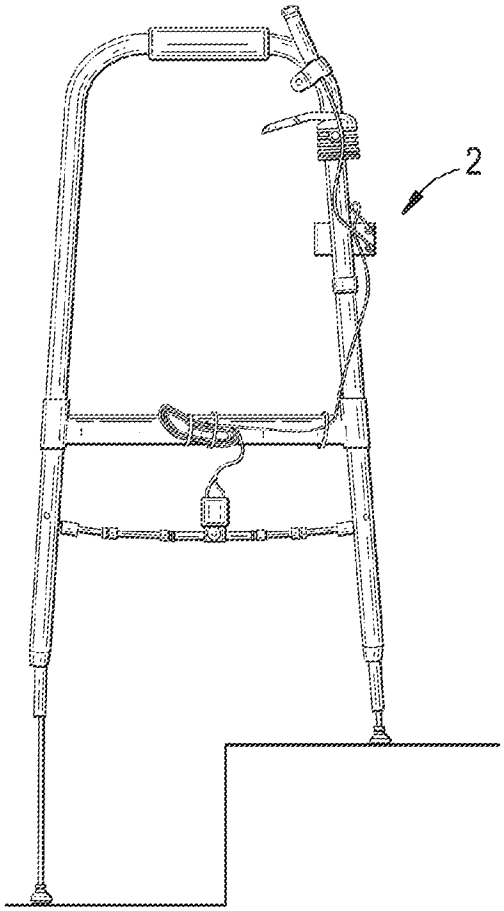
FIG. 5B is a side view of the self leveling walker of the present invention as illustratively employed during stair ascent.
Figure 5A:
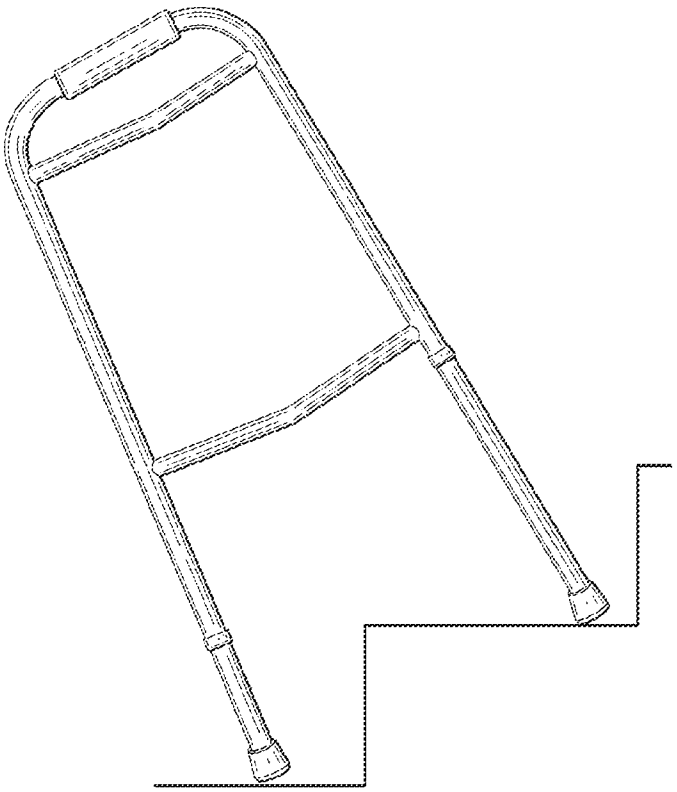
FIG. 5A PRIOR ART
FIG. 5A is a side view of a conventional, non-self leveling walker as illustratively employed during stair ascent.
Figure 5D:
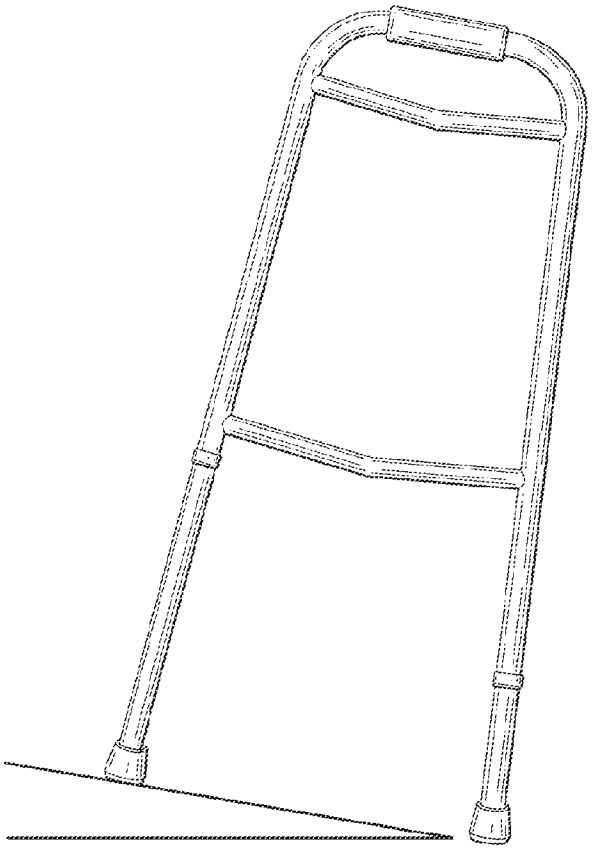
FIG. 5D PRIOR ART
FIG. 5D is side view of a conventional, non-self leveling walker as illustratively employed during ramp ascent.
Figure 5C:
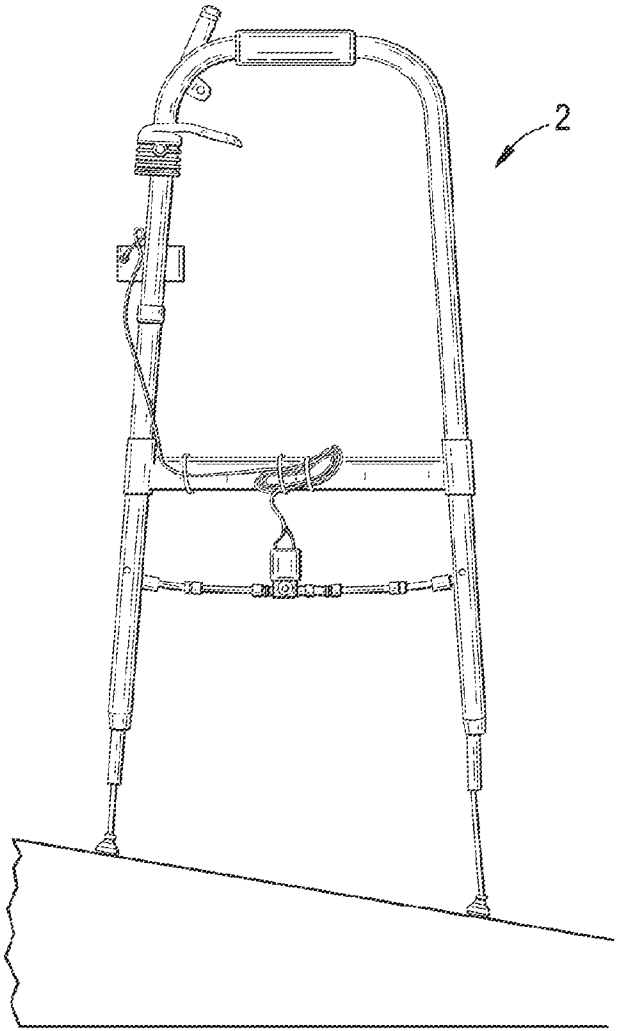
FIG. 5C is a side view of the self leveling walker of the present invention as illustratively employed during ramp ascent.

As referenced, the activation mechanism comprises control valves that are chosen from the group comprising at least one directional control valve (not depicted) as a means for controlling the pair of adjustable rear legs 18*a*, 18*b* and the pair of adjustable front legs 16*a*, 16*b* on the respective left and right sides (e.g., on left frame support 6 and a right frame support 8 respectively), or as depicted, one left side valve 20*a* and one right side valve 20*b* and at least one complementary left side activation line 12*a* and at least one complementary right side activation line 12*b* which all can be externally or internally attached to the frame assembly as a means for controlling said pair of adjustable rear legs 18*a*, 18*b* and said pair of adjustable front legs 16*a*, 16*b*. As contemplated, adjustable rear leg 18*a* extends from the rear, lower portion of left frame support 6, and the adjustable front leg 16*a* extends from the front, lower portion of left frame support 6, wherein both are connected to each other via at least one complementary left side activation line 12*a*, and similarly, the adjustable front leg 16*b* extends from the front, lower portion of right frame support 8 and the adjustable rear leg 18*b* extends from the rear, lower portion of right frame support 8 wherein both are connected to each other via at least one complementary right side activation line 12*b*. In certain embodiments, complementary left side activation line 12*a* and complementary right side activation line 12*b* can be either pneumatic lines or hydraulic lines, while leveling assembly 10 can electrically (electronically) control the same respectively through the activation mechanism as described, but can also utilize sensors, such as tilt sensors, such as inertial or pressure sensors (not depicted), in providing an automatic control option. In such an automated embodiment, pressure sensors can sense pressure values within the complementary left and right side activation lines 12*a*, 12*b* or alternatively, can sense the inclination, acceleration, stress and the like of frame assembly 4, so as to open and close at least one respective left side valve 20*a*, right side valve 20*b* attached thereto, whereby the sensors redistribute fluid or air within the complementary left and right side activation lines 12*a*, 12*b*, to a plurality of leveling pistons (not depicted) that are situated so as to be contained within each respective leg of the pair of adjustable rear legs 18*a*, 18*b* and of the pair of adjustable front legs 16*a*, 16*b*. It is noted that, in one embodiment, the activation mechanism may be provided as part of, or electrically connected to leveling assembly 10, and can operate in either an automatic mode setting that employs the sensors to provide deployment of the activation mechanism, or in a manual mode setting that uses single or dual control buttons 24 that can prevent mistaken deployment of the activation mechanism. Another alternative embodiment also provides for the activation mechanism to include an automatic lock/unlock feature (not depicted) of control and at least one accelerometer or other inertial sensor for use when operating in the automatic mode. In a further alternative embodiment, adjustable rear legs 18*a*, 18*b* and adjustable front legs 16*a*, 16*b* may each include friction and weight reduction mechanisms (not depicted) which may comprise leveling cylinders/pistons complete with the addition of spring-assisted returns that reduce weight and friction in certain cases. When provided in accordance with the above, self-leveling walker 2 can adjust, as depicted in FIGS. 4A and 4B, the respective height of adjustable rear legs 18*a*, 18*b* and adjustable front legs 16*a*, 16*b* in order to accommodate the ascent and descent of stairs and inclines, which provides notable advantages when compared side-by-side with non-self leveling walkers, as comparatively depicted respectively in FIGS. 5A and 5B.

Figure 6:
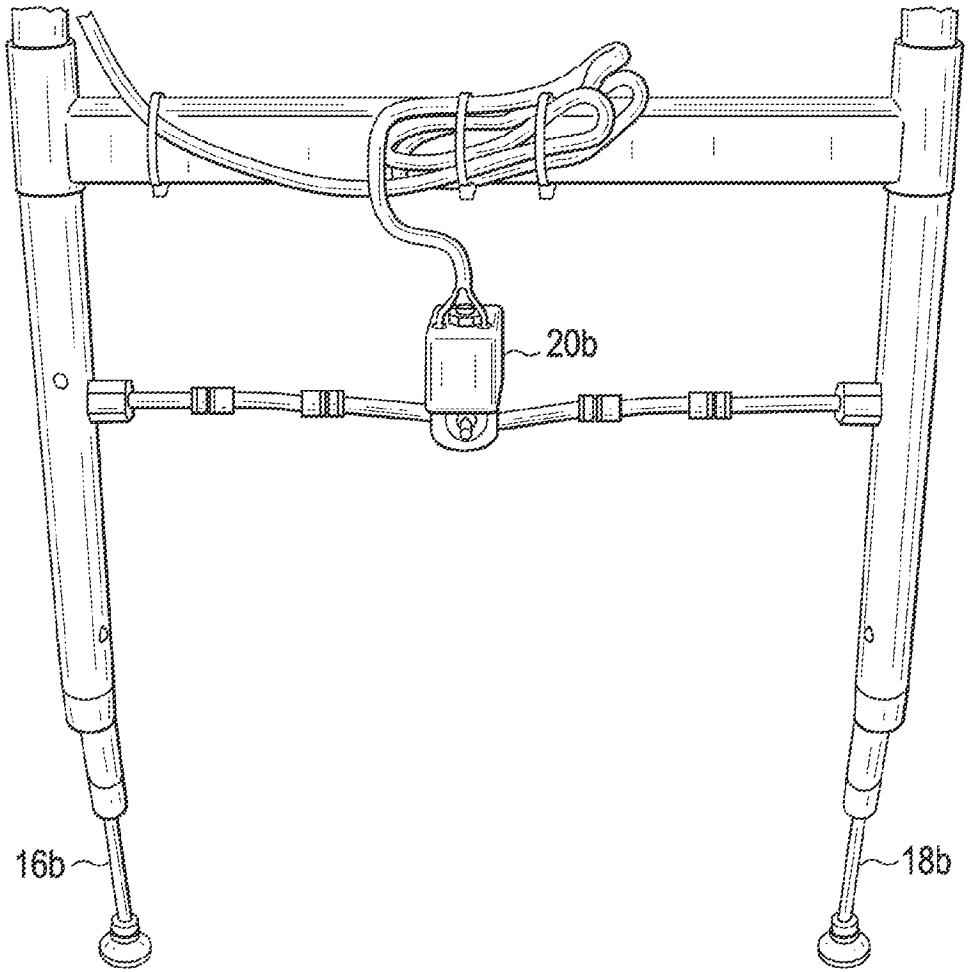
FIG. 6 is a side close up view of a portion of the leveling assembly from one side, including portions of the lift mechanism comprising a front side valve actuator and a rear side valve actuator and accompanying activation lines of the self leveling walker of the present invention.
Figure 8:
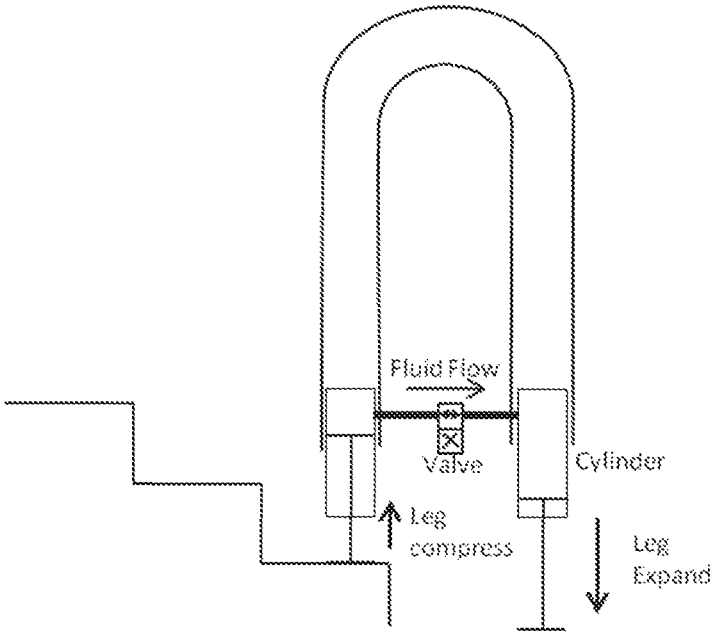
FIG. 8 is a schematic of illustrative pressure flow during stair traversal of the self leveling walker of the present invention, wherein the pressure flow of one exemplary embodiment of hydraulic type activation lines are regulated by a valve or valve actuator, such that the pressure of one set of walker legs being compressed/retracted translates into pressure transference to an opposing set of legs which cooperatively expand/extend.

In accordance with illustrative structural materials and exemplary components described above, the following text describes in greater detail the composition, operation, and uses of each of the aforementioned components of the inventive lift walker. As mentioned, self leveling walker 2 can use either pneumatic or hydraulic cylinders (pistons), and associated control valves therewith to direct fluid flow to adjust the height of the legs. When traversing a substantially flat or even surface, self leveling walker 2 is normally locked, with no dynamic output from leveling assembly 10. However, with input (either by manually pressing activation button 24, or by automatic means, such as electronic sensors as described herein) elevator assembly 10 can activate the activation mechanism which in turn manipulates the hydraulic or pneumatic pressure within complementary left side activation line 12*a* and complementary right side activation line 12*b* through opening and closing of the control valves, namely exemplary left side valve 20*a* and right side valve 20*b* (as illustratively depicted by way of the detailed illustration of one side, seen in FIG. 6), respectively, in order to effectuate the respective height of adjustable rear legs 18*a*, 18*b* and adjustable front legs 16*a*, 16*b* so as to accommodate the ascent and descent of stairs and inclines and generally, to adjust to various terrains in a synchronized fashion that affords a surface dependent alignment of the same. Thus, the design works by opening left side valve 20*a* and right side valve 20*b* simultaneously to direct fluid flow to either the front or back legs, as depicted in FIG. 8, such that when a user approaches an incline, he places the self leveling walker 2 on the slope to be traversed, and allows the legs to adjust in an automatic, continuous (e.g., dynamic and ongoing) fashion which does not rely on inflexible, discrete levels of user-initiated ad hoc adjustments. If, for example, the terrain to be traversed is uphill, leveling assembly 10 is activated and will then open left side valve 20*a* and right side valve 20*b*, and thereafter, that the relatively greater force exerted by the ground against front legs 16*a*, 16*b* (as compared to the force exerted by the ground against rear legs 18*a*, 18*b*) will necessarily push against front legs 16*a*, 16*b* which will, in turn, push the abutting front cylinders or pistons (not depicted) contained within the tubing of frame 4 thereby automatically shortening (retracting) front legs 16*a*, 16*b* back into the tubing of frame 4, and so that the fluid (or air, if pneumatic) will flow from (be displaced by) the front cylinders and will be directed continuously through both left and right sides, respectively, of self leveling walker 2, via complementary left side activation line 12*a* and complementary right side activation line 12*b*, to the rear cylinders or pistons (not depicted) contained within the tubing of frame 4, abutting rear legs 18*a*, 18*b*, thereby automatically lengthening (extending) rear legs 18*a*, 18*b* from the tubing of frame 4. This provides for a virtually unlimited number of adjustments in levels between back and front, and accordingly, allows a horizontal axis (not depicted) coincident with the hand grips of the self-leveling walker 2 to be perpendicular to the force of gravity (e.g., parallel to a true level ground orientation/true horizontal axis), rather than following the slope of the incline, as would be the case with conventional non-self leveling walkers, something which is much more stable and safe for a user, and lessens the likelihood of the user from falling back or falling forward given that they need not lean forward or back to accommodate a static conventional walker that remains parallel to the inclined surface. Once front legs 16*a*, 16*b* and rear legs 18*a*, 18*b* have been correctly adjusted as described above, left side valve 20*a* and right side valve 20*b* will close (as controlled by leveling assembly 10, through either manual or automatic means as described herein) and front legs 16*a*, 16*b* and rear legs 18*a*, 18*b* will thereby lock (close) in the current surface dependent aligned position until level ground is reached again. When traversing a decline, the above is essentially the same, except for the relative magnitude of pressure exhibited respectively on front legs 16*a*, 16*b* and rear legs 18*a*, 18*b* (and of course, the cylinders abutting thereof) and the direction of the fluid (air flow) is necessarily reversed as well. The same procedures and inventive mechanics are also followed for stairs, and the ascending or descending thereof. Similarly, the user places front legs 16*a*, 16*b* on the first step and the respective legs are adjusted (e.g., front legs 16*a*, 16*b* compress, while rear legs 18*a*, 18*b* extend), until the walker is parallel to the ground. Once the walker is set for the first step, the user/leveling assembly 10 need not implement additional adjustments to the relative heights of front legs 16*a*, 16*b* and rear legs 18*a*, 18*b* again, because leveling assembly 10 will maintain the first step configuration, which can be re-used for each successive step. Once the user reaches the top step, the walker may be return (either by automatic means or manual means) to its standard, level configuration with all legs of equal length. The reverse is true for travelling down a set of stairs. By way of contrast, a conventional non-self leveling walker would be extremely challenging to use on stairs, because it would always be at an unusable angle and would provide no real support, as comparatively depicted in FIGS. 5A and 5B.

Figure 9:
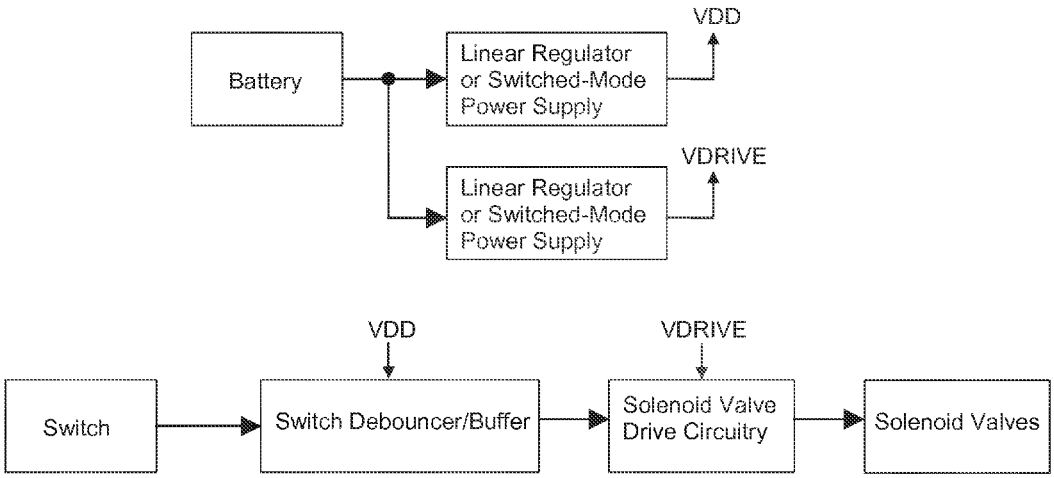
FIG. 9 is a block diagram of the electrical circuitry and control utilized in one illustrative embodiment of the leveling assembly of the self leveling walker of the present invention.

It is noted that in one alternative embodiment, self leveling walker 2 may provide opening and closing of left side valve 20*a* and right side valve 20*b* through the use of solenoid valves, as generally depicted in FIG. 9, which shows one illustrative block diagram of the electronic circuitry and electrical control of leveling assembly 10. Such solenoid valves are normally found in the closed position, such that self leveling walker 2 is locked and cannot be adjusted until the solenoid valves are powered. The solenoid valves open when powered, thereby allowing hydraulic fluid (or air) to flow, thereby permitting adjustment of front legs 16*a*, 16*b* and rear legs 18*a*, 18*b* as described above. As shown in FIG. 9, a battery, power supply, switch, and solenoid valve drive circuitry are required for controlling or driving the solenoid valves. By way of one illustrative, non-limiting example, one might employ a lithium-ion battery pack (such as the Sony NP-F770 model, available from Sony Corporation of Tokyo, Japan), an off-the-shelf 5V linear regulator, an off-the-shelf 12V boost converter, an off-the-shelf momentary pushbutton switch, an off-the-shelf MAX6816 switch debouncer, as well as an off-the-shelf N-channel power MOSFET and off-the-shelf fly-back diode for driving each solenoid valve, such as four separate Allenair 12V, 7 W normally closed solenoid valves, available from Allenair Corporation of Mineola, N.Y., and a Clippard 9/16 bore, 6 stroke pneumatic cylinder, available from Clippard Instrument Laboratory, Inc. of Cincinnati, Ohio. Although the above dimensions and sizes may be altered in various ways at the time of manufacture or upon user customization, according to the scope of the present invention, in one particular embodiment, one might employ an 8 inch stroke pneumatic cylinder, given that the standard step height is normally 8 inches, and a pneumatic cylinder sized to accommodate other common obstacles might prove advantageous in certain embodiments. Nevertheless, with the inventive design, the user can power the solenoid valves and adjust self leveling walker 2 by holding the momentary pushbutton switch (e.g., activation button 24) in. When provisioned as such, the use releases the pushbutton switch, power to the solenoid valves is removed, and self leveling walker 2 returns to a locked (closed control valve) state.

Alternatively, the present invention provides for a power-free embodiment that need not be electrically actuated at all, and which consequently would not need to employ solenoid valves as described above. To this end, self leveling walker 2 may provide opening and closing of left side valve 20*a* and right side valve 20*b* through the use of check valves which open at a fixed pressure (i.e. cracking pressure"), wherein fluid would flow from say, front legs 16*a*, 16*b* to rear legs 18*a*, 18*b* (and vice-versa) thereby leveling self leveling walker 2 if enough weight were put on one set of legs so as to increase the pressure in the aforementioned pneumatic or hydraulic cylinders (pistons) enough in such a way as to blow past the check valves. In a further embodiment, the check valves could be field customizable and tunable according to user indicia. Such field customization and tuning according to user indicia might, in one embodiment, be accomplished by selecting a check valve rated for some percentage of the user body weight from an inventory of components spanning a range of characteristics and installing it in the circuit. For example, after measuring user body weight and determining that a specific user normally places say, 50% of body weight on his/her legs while using the walkers, check valves rated at perhaps 25% of body weight could be selected and installed between the front and rear legs on each of the left and right sides of the self leveling walker. This would allow fluid to flow from the front to rear legs to adjust their relative lengths to accommodate changes in surface height when the user places more than a total of say, 50% body weight on the front legs, such as when ascending a ramp. Once on a level surface again, the user would lean backwards or change the positions of their hands on the walker handles to place more than 50% body weight on the rear legs until the walker is leveled and returns to the nominal position. Operation can then be evaluated and customized for user comfort and safety by replacing the check valves initially selected by ones with higher or lower ratings. In an alternative embodiment, check valves with adjustable cracking pressures that are field tunable by a technician or the user in the field can be incorporated into the self leveling walker, rather than replacing valves with fixed flow through pressures. The appropriate cracking pressure might, in one illustrative embodiment, be set by say, manipulating an adjusting screw to alter a poppet spring tension or other internal configuration of the valve and locking the new spring length and cracking pressure at the desired value.

Figure 10:
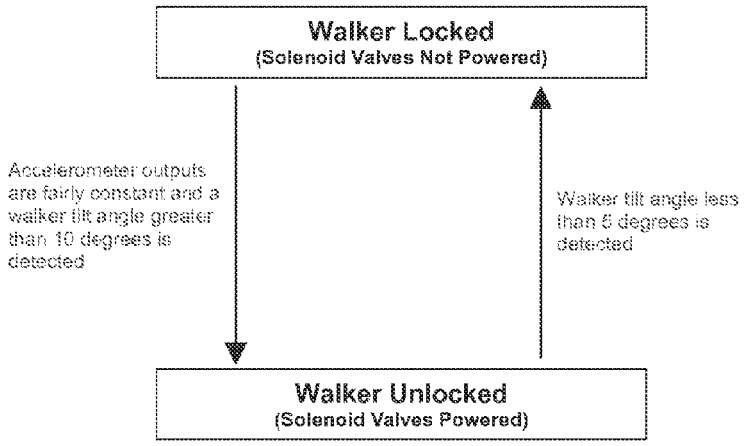
FIG. 10 is an illustrative algorithm of an automatic lock/unlock feature of control utilized in one illustrative embodiment of the leveling assembly of the self leveling walker of the present invention.

One alternative embodiment of the present invention provides for automation of activation of leveling assembly 10 through the addition of sensors such as strain gages, accelerometers, gyroscopes and/or magnetometers and the like, and a microcontroller (not depicted) that could allow for an optional automatic lock/unlock control of self leveling walker 2 based upon sensed values, wherein the sensors would augment or replace the sensing of any pressure sensors used as pressure monitors of fluid/air, for signaling redistribution of the fluid or air within complementary left side activation line 12*a* and within complementary right side activation line 12*b*, to a plurality of leveling pistons (cylinders) situated contained within adjustable legs 16*a*, 16*b*, 18*a*, 18*b*. Such a feature would be beneficial for individuals with limited finger dexterity and strength. In this embodiment, the sensors would act to sense inclination, orientation with respect to gravity, or forces and stresses on the frame assembly. An example of this type of sensor would be the LIS344ALH, 3-axis linear accelerometer available from ST Microelectronics of Geneva, Switzerland. Note the small size of this type of sensor (4×4×1.5 mm) and it could very easily be integrated into the design of self leveling walker 2. The distribution of the gravitational vector on the accelerometer axes would indicate the angle of self leveling walker 2. The microcontroller could continuously sense or sample the accelerometer outputs and automatically lock/unlock self leveling walker 2 based on theses accelerometer values. As illustratively depicted in FIG. 10, one possible algorithm for implementing the above within electronic circuitry of leveling assembly 10 is shown in FIG. 10. Note that this algorithm requires the accelerometer outputs to be fairly constant before unlocking self leveling walker 2, in order to prevent tilt angles of self leveling walker 2 that are greater than threshold seen during normal user/motion of self leveling walker 2 from unlocking self leveling walker 2. As such, the present invention is not meant to be limited to this particular instantiation, as more advanced algorithms could also be applied by adding an inertial sensing module such as an ST Microelectronics LSM330DLC (accelerometer and gyroscope) to self leveling walker 2.

Figure 7:
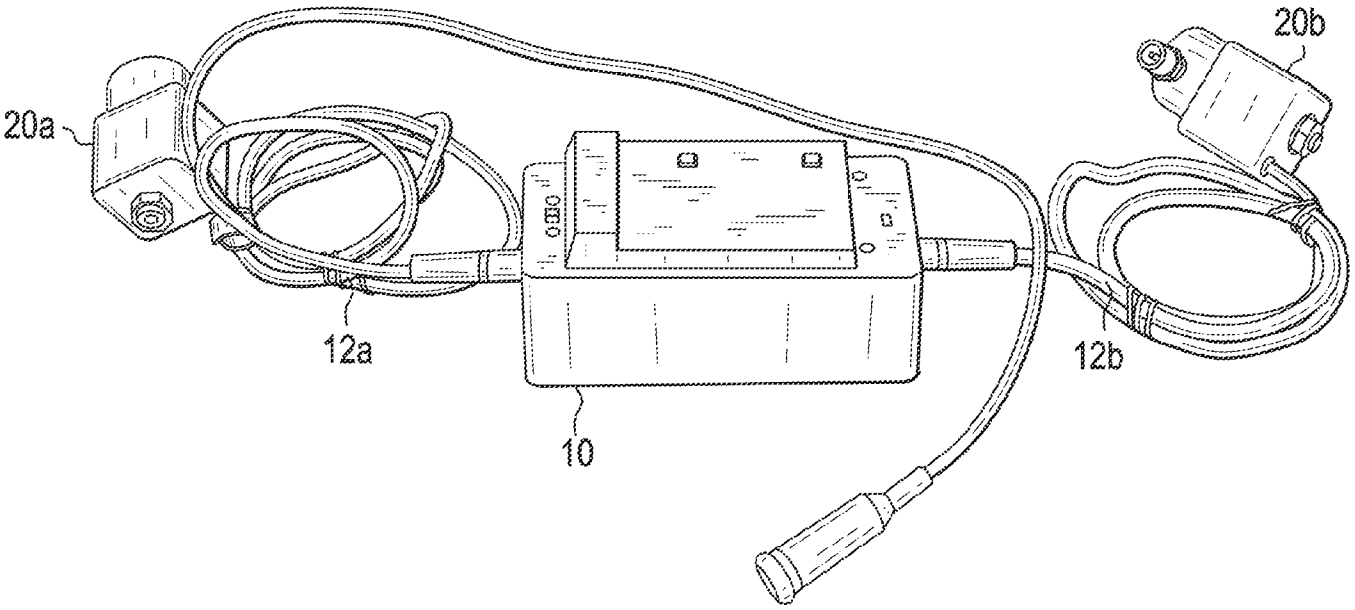
FIG. 7 is a depiction of a leveling assembly prior to attachment to a self leveling walker, or when used as a major component of a retrofit kit for converting a standard walker to a self leveling walker, excluding actuators/cylinders/pistons, but including the leveling assembly with an illustrative push-button switch, side valve actuators and accompanying complementary activation lines of the self leveling walker of the present invention.
Figure 11:
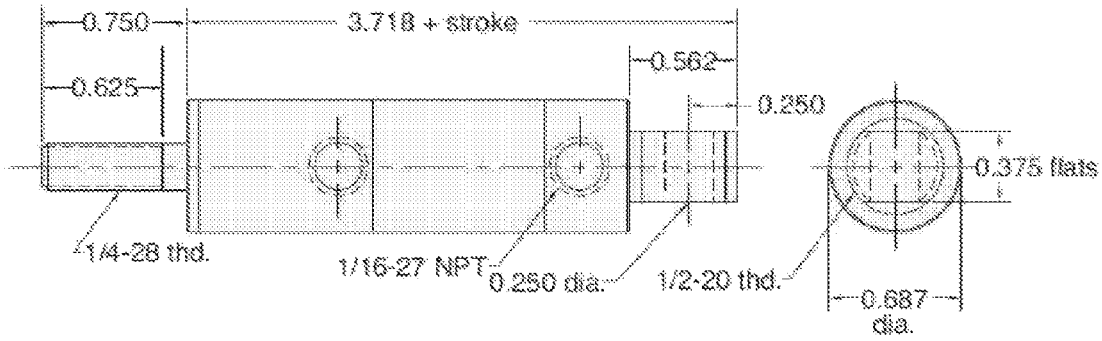
FIG. 11 is an illustrative depiction of one possible embodiment of an individual leveling piston or cylinder that may be used by the leveling assembly of the self leveling walker of the present invention for leveling (extending or retracting) a plurality of walker legs.

Although described herein primarily within the context of a specific embodiment that contemplates self leveling walker that is specifically constructed as an entire integrated unit, it is noted that the present invention also contemplates provision of the inventive features by modification of non-self leveling walkers through provision as a retrofit kit that can be added on to existing walkers, as shown in detached form in FIG. 7, which shows leveling assembly 10 and the components thereof, with the exception of the pistons or cylinders described above, which might be added to the pairs of front and back legs of a conventional walker through many different approaches, such as through usage of say, a ring with a spring loaded lock attached to an upper portion of each piston/cylinder for sliding the same on and off of a standard walker. By way of one such example, conventional (non-self leveling) walkers have lower leg sections that are normally adjusted in a static fashion by use of a standard spring-loaded button and hole, but could be modified to have some of the inventive dynamic height adjustment features within the respective legs by replacement the lower sections with the retractable/extensible legs described herein, all of which can be activated and controlled by addition and interconnection of the inventive leveling assembly as described herein. In one embodiment, it is possible to employ the present invention by simply retrofitting existing walkers that normally adjust for height only via the inventive pistons described herein, and employ the techniques described herein to level the walker across uneven surfaces, after the height of a walker has already been adjusted to the user's given height through conventional telescoping leg extensions. Additionally, in yet another alternative embodiment, it may is possible to configure the inventive self leveling walker to have wheels on the retractable/extensible legs, especially on the front legs, if desired for ease of mobility. In such an embodiment, it would be optimal to employ cylindrical leveling shafts (pistons/cylinders) that are not necessarily round as illustratively depicted in FIG. 11, but instead might be square shaped or keyed so that once any optional wheels were attached, the wheel units would not exhibit undesirable ranges of rotation like that which might be found in casters, but would instead have an angle of rotation that would be primarily directed towards the user s intended line of motion. Note that in one additional alternative embodiment, provision might be made for leveling assembly 10 to include a self leveling mechanism for self leveling from left to right (e.g., independent, side-to-side adjustability) of self leveling walker 2, which might illustratively provide for say, the hydraulic or pneumatic circuit between the front and back (complementary left side activation line 12*a* and complementary right side activation line 12*b*) to be connected with additional valves between the left side and right side of the self leveling walker, in order to adjust for surfaces that are laterally (e.g. side-to-side) uneven in view of the path of travel by a user. Provision of such in the present invention is a significant advance over the prior art and would be beneficial for users, especially when traversing banked surfaces to adjust to a horizontal level for stability, thereby obviating the need to turn toward the downhill as is the case with conventional walkers, or even when compared with fore-aft adjustable walkers. In such an alternative embodiment, leveling assembly 10 might more particularly be reconfigured to provide for additional self leveling from left to right of self leveling walker 2 (e.g., between the respective adjustable front and back legs found on frame support 6 and between the respective adjustable front and back legs found on right frame support 8) through simple modifications to complementary left side activation line 12*a* and complementary right side activation line 12*b* to include separate or additional activations lines (not depicted) and also, through simple modifications to the control electronics within leveling assembly 10 which would permit functionality such that, for example, a user could push say, one activation button for front leg/rear leg control and a second button for side-to-side (left leg/right leg control), or otherwise, to provide one activation button to free up the entire system up, such that all four legs of self leveling walker 2 would be free to dynamically (e.g., independently of each other) adjust, much as a dynamic suspension system is provided for on automobiles that can level out the weight of the passengers or cargo.

To this end, the present invention overcomes the aforementioned and other disadvantages inherent in the prior art. While several aspects of the present invention have been described and depicted herein, alternative aspects may be implemented by those skilled in the art to accomplish the same objectives. Accordingly, it is intended by the appended claims to cover all such alternative aspects as fall within the true spirit and scope of the invention.

We claim:

1. A self leveling walker comprising:

a frame assembly having a left side and a right side connected together;

a pair of adjustable front legs;

a pair of adjustable rear legs;

a leveling assembly mounted to said frame assembly, said leveling assembly comprising at least:

a single activation mechanism both for controlling and effectuating automatic, continuous extension and retraction of said pair of adjustable front legs in tandem and for controlling and effectuating automatic, continuous extension and retraction of said pair of adjustable rear legs in tandem simultaneously.

2. The self leveling walker of claim 1 wherein said activation mechanism includes control valves, said activation mechanism further including, mounted on a lower portion of said frame assembly, at least one complementary left side activation line and at least one complementary right side activation line, for opening said control valves as a means for effectuating said automatic, continuous extension and retraction of said pair of adjustable front legs and said pair of adjustable rear legs, and for closing said control valves as a means for completing a surface-dependent, synchronized alignment of said pair of adjustable front legs and said pair of adjustable rear legs.

3. The self leveling walker as recited in claim 2, wherein said control valves are chosen from the group comprising at least one directional control valve or at least one left side valve and at least one right said valve.

4. The self leveling walker as recited in claim 3, wherein:

said pair of adjustable front legs comprises an adjustable left front leg and an adjustable right front leg;

said pair of adjustable rear legs comprises an adjustable left rear leg and an adjustable right rear leg;

wherein said one adjustable left rear leg and said one adjustable left front leg are connected to each other via said at least one complementary left side activation line; and wherein said one adjustable right rear leg and said one adjustable right front leg are connected to each other via said at least one complementary right side activation line; and wherein said pair of adjustable front legs and said pair of adjustable rear legs are both controlled by one activation button.

5. The self leveling walker as recited in claim 4, wherein said at least one complementary left side activation line and said at least one complementary right side activation line are both chosen from the group comprising pneumatic or hydraulic lines.

6. The self leveling walker as recited in claim 5, wherein said assembly includes check valves for controlling said activation mechanism.

7. The self leveling walker as recited in claim 6, wherein said check valves are field customizable and tunable according to user indicia.

8. The self leveling walker as recited in claim 5, wherein said leveling assembly includes circuitry for controlling said activation mechanism electrically.

9. The self leveling walker as recited in claim 8, wherein said leveling assembly controls said activation mechanism automatically through sensors, said sensors being tilt sensors.

10. The self leveling walker as recited in claim 9, wherein said sensors further include hydraulic pressure sensors, wherein said hydraulic pressure sensors sense pressure values within said at least one complementary left side activation line, so as to open and close said at least one left side valve, and also sense pressure values within said at least one complementary right side activation line, so as to open and close said at least one right side valve, whereby said pressure sensors signal redistribution of fluid or air within said at least one complementary left side activation line and within said at least one complementary right side activation line, to a plurality of leveling pistons situated contained within said pair of adjustable rear legs and said pair of adjustable front legs.

11. The self leveling walker as recited in claim 10, wherein said pair of adjustable front legs and said pair of adjustable rear legs each include friction and weight reduction mechanisms, said friction and weight reduction mechanisms comprising leveling cylinders and spring-assisted returns.

12. The self leveling walker as recited in claim 11, wherein said tilt sensors augment said pressure sensors in signaling redistribution of said fluid or air within said at least one complementary: left side activation line and within said at least one complementary right side activation line, to said plurality of leveling pistons situated contained within said pair of adjustable rear legs and said pair of adjustable front legs.

13. The self leveling walker as recited in claim 12, wherein said leveling assembly includes at least one of the following of either an automatic mode setting for employing said sensors to provide deployment of said activation mechanism, or through a manual mode setting for employing dual control buttons that prevent mistaken deployment of said activation mechanism.

14. The self leveling walker as recited in claim 13, wherein said leveling assembly includes an automatic lock/unlock feature of control and at least one accelerometer for operation in said automatic mode.

15. The self leveling walker as recited in claim 14, wherein said leveling assembly includes a self leveling mechanism for self leveling between said left side and between said right side of said self leveling walker.

16. A self leveling walker retrofit kit for mounting on an existing separate frame assembly of a walker comprising:

a leveling assembly, said leveling assembly comprising at least:

a plurality of leveling components;

a single activation mechanism both for controlling and effectuating automatic, continuous fluid flow directed extension and retraction of plurality of leveling components in tandem together in a synchronized, simultaneous fashion.

17. The self leveling walker retrofit kit of claim 16 wherein said activation mechanism is mounted on said frame assembly, and includes control valves, said activation mechanism further including, mounted on a lower portion of said frame assembly, at least one complementary left side activation line and at least one complementary right side activation line for opening said control valves for effectuating said automatic, continuous extension and retraction of said plurality of leveling components, and for closing said control valves for completing a surface-dependent, synchronized alignment of said plurality of leveling components.

18. The self leveling walker retrofit kit as recited in claim 17, wherein said control valves are chosen from the group comprising at least one directional control valve or at least one left side valve and at least one right said valve.

19. The self leveling walker retrofit kit as recited in claim 18, wherein:

said plurality of leveling components include pistons for a pair of adjustable front legs including at least one piston for one adjustable left front leg and at least one piston for one adjustable right front leg, and pistons for a pair of adjustable rear legs including at least one piston for one adjustable left rear leg and at least one piston for one adjustable rear right leg; wherein:

said at least one piston for one adjustable left front leg and said at least one piston for one adjustable left rear leg are connected to each other via said at least one complementary left side activation line, and wherein:

said at least one piston for one adjustable right front leg and said at least one piston for one adjustable right rear leg are connected to each other via said at least one complementary right side activation line; and wherein said pair of adjustable front legs and said pair of adjustable rear legs are both controlled by one activation button.

20. The self leveling walker retrofit kit as recited in claim 19, wherein said at least one complementary left side activation line and said at least one complementary right side activation line are both chosen from the group comprising pneumatic or hydraulic lines.

21. The self leveling retrofit kit walker as recited in claim 20, wherein said leveling assembly includes check valves for controlling said activation mechanism.

22. The self leveling retrofit kit walker as recited in claim 21, wherein said check valves are field customizable and tunable according to user indicia.

23. The self leveling walker retrofit kit as recited in claim 20, wherein said leveling assembly includes circuitry for controlling said activation mechanism electrically.

24. The self leveling walker retrofit kit as recited in claim 23, wherein said leveling assembly controls said activation mechanism automatically through sensors, said sensors being tilt sensors.

25. The self leveling walker retrofit kit as recited in claim 24, wherein said sensors further include fluid pressure sensors, wherein said fluid pressure sensors sense pressure values within said at least one complementary left side activation line, so as to open and close said at least one left side valve, and also sense pressure values within said at least one complementary right side activation line, so as to open and close said at least one right side valve, whereby said fluid pressure sensors signal redistribution of fluid within said at least one complementary left side activation line and within said at least one complementary right side activation line, to said plurality of leveling components.

26. The self leveling walker retrofit kit as recited in claim 25, wherein said tilt sensors augment said fluid pressure sensors in signaling redistribution of said fluid with in said at least one complementary left side activation line and within said at least one complementary right side activation line, to said plurality of leveling components.

27. The self leveling walker retrofit kit as recited in claim 26 wherein said leveling assembly includes at least one of the following of either an automatic mode setting for employing said sensors to provide deployment of said activation mechanism, or through a manual mode setting for employing dual control buttons that prevent mistaken deployment of said activation mechanism.

28. The self leveling walker retrofit kit as recited in claim 27, wherein said leveling assembly includes an automatic lock/unlock feature of control and at least one accelerometer for operation in said automatic mode.

29. The self leveling walker retrofit kit as recited in claim 28, wherein said leveling assembly includes a self leveling mechanism for self leveling between said left side and between said right side of said self leveling walker.

* * * * *